US007740929B2

(12) United States Patent
Burton et al.

(10) Patent No.: US 7,740,929 B2
(45) Date of Patent: Jun. 22, 2010

(54) HARD WOOD STRAND PRODUCTS

(75) Inventors: Peter Edward Burton, Keppel Sands (AU); Graham Thomas Coulthard, Berwick (AU)

(73) Assignee: Lignor Limited, Keppel Sands, Queensland (AU)

( * ) Notice: Subject to any disclaimer, the term of this patent is extended or adjusted under 35 U.S.C. 154(b) by 408 days.

(21) Appl. No.: 10/597,259

(22) PCT Filed: Dec. 14, 2004

(86) PCT No.: PCT/AU2004/001756

§ 371 (c)(1),
(2), (4) Date: Sep. 5, 2006

(87) PCT Pub. No.: WO2005/070667

PCT Pub. Date: Aug. 4, 2005

(65) Prior Publication Data

US 2008/0226867 A1 Sep. 18, 2008

(30) Foreign Application Priority Data

Jan. 27, 2004 (AU) ..... 2004900364

(51) Int. Cl.
*B32B 5/00* (2006.01)
*B32B 7/00* (2006.01)
*E04C 1/00* (2006.01)

(52) U.S. Cl. ..... 428/114; 52/309.1; 428/98; 428/221; 428/298.1; 428/299.1; 428/332

(58) Field of Classification Search ..... 428/114, 428/98, 298.1, 299.1, 332, 221; 52/309.1
See application file for complete search history.

(56) References Cited

U.S. PATENT DOCUMENTS

| | | | | |
|---|---|---|---|---|
| 4,246,310 | A | 1/1981 | Hunt et al. | |
| 4,361,612 | A * | 11/1982 | Shaner et al. | 428/106 |
| 4,610,913 | A | 9/1986 | Barnes | |
| 6,129,871 | A * | 10/2000 | Suzuki et al. | 264/51 |
| 2003/0064230 | A1 * | 4/2003 | Liu et al. | 428/425.1 |
| 2003/0189039 | A1 * | 10/2003 | Vinden et al. | 219/678 |

FOREIGN PATENT DOCUMENTS

| | | |
|---|---|---|
| AU | 7719787 | 3/1988 |
| AU | 199924055 | 9/1999 |
| CN | 1149524 | 5/1997 |
| CN | 13933335 | 1/2003 |

OTHER PUBLICATIONS

DeltaStrand Triangular Lumber (TSL), retrieved from Internet Nov. 5, 2004.

Lam, Modern Structural Wood Products, Prog. Struct. Engng Mater., 2001, vol. 3, pp. 238-245.

Rongjun et al "The Properties and Manufacturing Technology of Plywood for Concrete Formwork Made from Imported Eucalyptus Wood", China Forest Products Industry, 2003, vol. 30, term 5.

Iwakiri et al "Production of Oriented Strand Board (OSB) from Eucalyptus Grandis etc.", Ciencia Florestal, vol. 13/No. 1, 2003, pp. 89-94.

Iwakiri et al "Use of Eucalyptus Wood for Oriented Strand board (OSB) Manufacturing", Cerne, vol. 10, No. 1, Jun. 2004, pp. 46-53.

* cited by examiner

*Primary Examiner*—Brent T O'Hern
(74) *Attorney, Agent, or Firm*—Dennison, Schultz & MacDonald

(57) ABSTRACT

A strand lumber or board product based on eucalypt species and an iso-cyanate binder such as PMDI.

13 Claims, 1 Drawing Sheet

HARD WOOD STRAND PRODUCTS

BACKGROUND TO THE INVENTION

This invention relates to hardwood products and particularly but not only to strand lumber and board products formed from eucalypts.

A number of man made timber products are known including particle board (PB), medium density fibreboard (MDF), plywood, laminated veneer lumber (LVL) and oriented strand board (OSB).

Particle board lacks sufficient strength for most structural uses. Plywoods require veneer sheets from relatively high grade logs. MDF products have a number of uses but generally lack structural strength and moisture resistance. OSB and LVL products have a broad range of uses but also suffer from a relatively low resistance to moisture. Their structural strength and holding capacity for fastenings is also directional.

LVL is an adaptation of old technology from the plywood industry and is similarly reliant on old or larger diameter trees, typically 40 years old or more, and around 500 mm in diameter. This provides a relatively low conversion rate from log to LVL product.

Laminated strand lumber (LSL) is another man made timber product but is based on softwoods such as aspen and yellow poplar. These species grow relatively rapidly and this product has also found commercial use as a construction lumber.

SUMMARY OF THE INVENTION

It is an object of the present invention to provide an improved strand lumber or board product formed from one or more hardwoods or at least to provide an alternative to existing products.

In one aspect the invention may be said to reside in a strand lumber or board product including substantially aligned strands of one or more eucalypts species bonded together with a binder including an isocyanate resin.

In a preferred embodiment the eucalypt species are Bluegum (*E. Globulus*), Karri (*E. Diversicolor*), Sydney Bluegum (*E. Saligna*), Marri (*E. Calophylla*) or Jarrah (*E. Marginata*), and the binder includes a polymeric methane di-isocyanate (PMDI) resin. The binder preferably also includes a wax such as a paraffin emulsion.

Preferably the strands have an average length of between 145 mm and 180 mm, an average width of about 10 to 25 mm, and an average thickness of between 0.5 mm and 1.5 mm. Preferably at least 70% of the strands are fully aligned.

DESCRIPTION OF FIGURE

Preferred embodiments of the invention will be described with reference to the accompanying drawing which schematically shows a method of forming a strand lumber product.

DETAILED DESCRIPTION OF THE PREFERRED EMBODIMENTS

Figure 1:
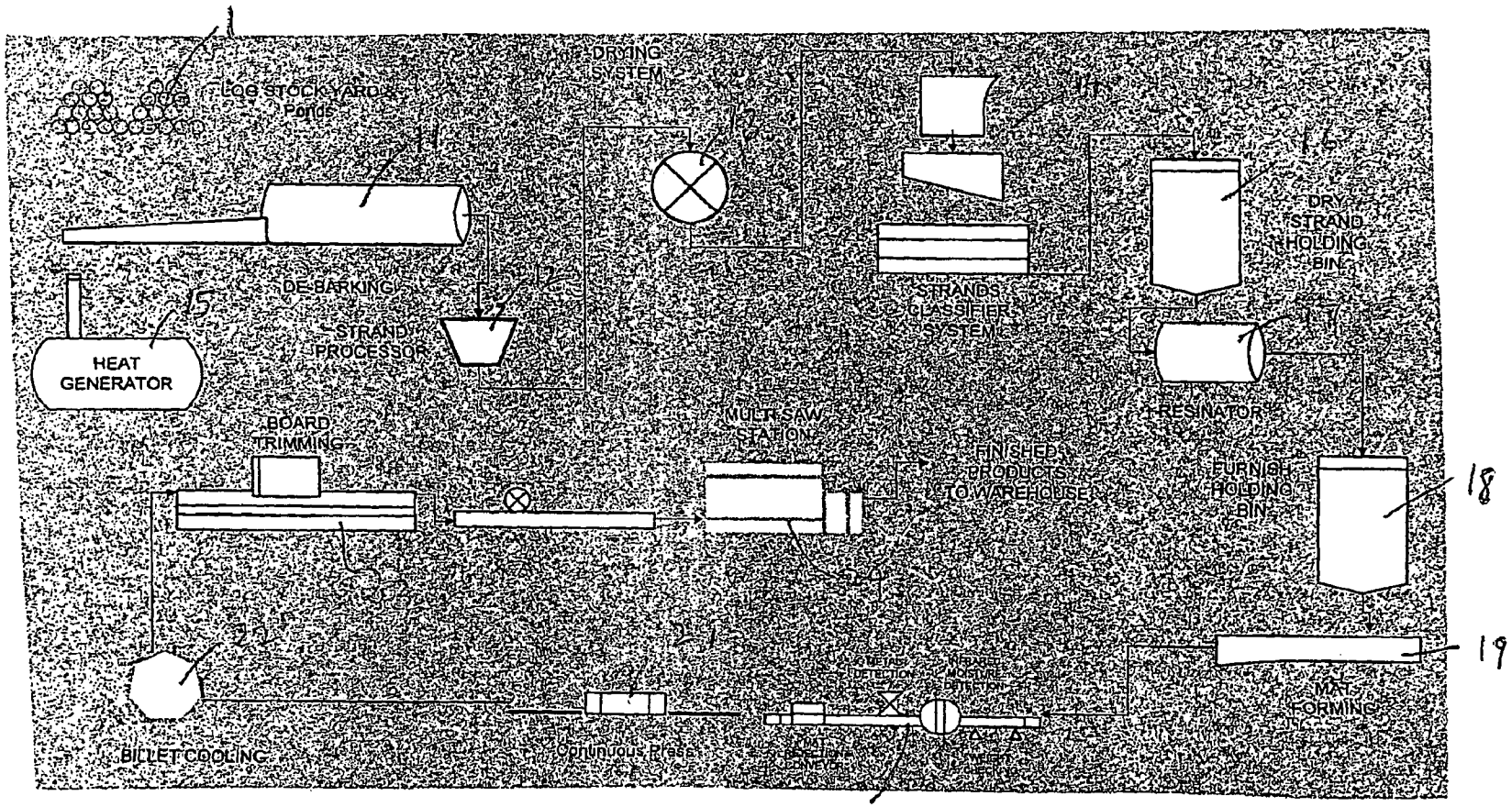

Referring to the drawing it will be appreciated that the invention can be implemented in a variety of different products for a range of purposes. The process outlined here is based on the Siempelkamp ContiRoll™ system and is given by way of example only. Other processes for manufacturing strand lumber or board products may also be suitable.

As shown in the drawing, the process begins with harvested logs of the genus eucalyptus and perhaps other similar hard wood logs 10. The preferred eucalypt species are Bluegum (*E. Globulus*), Karri (*E. Diversicolor*), Sydney Bluegum (*E. Saligna*), Marri (*E. Calophylla*) or Jarrah (*E. Marginata*). In the case of plantation trees such as Bluegum (*E. Globulus*) and Sydney Bluegum (*E. Saligna*) the trees are preferably around 8 to 12 years old and have a diameter of around 150 to 200 mm. In the case of forest thinnings such as Karri (*E. Diversicolor*), Marri (*E. Calophylla*) or Jarrah (*E. Marginata*) the trees are preferably less than 30 years old and less than 400 mm diameter. Single species may be used in a particular product or multiple species may be combined.

The logs are debarked 11 before passing through a strander 12. A ring strander is typically used to cut logs of fixed or random length into strands of a specified length, width and thickness. The strands are preferably formed with a length of about 145 mm to 180 mm, a width of about 10 to 25 mm and a thickness of about 0.5 to 1.5 mm.

The strands are dried 13 to preferably less than 5% moisture and are then classified in sieves 14 according to product specifications. A bin 16 holds the dried and classified strands until required.

Waste bark or rejected strands and fines provide the fuel for a heat plant 15 that generates heat for the drier and other parts of the process. About 70% of the original logs can be used to form product. Most of the remaining 30% can be used in the heat plant.

From bin 16 the strands are conveyed on demand to a resin blender 17 in which resin and wax are added in required proportions, typically about 6 to 10% of dry matter and 2% of dry matter respectively. The mixed strand resin and wax is known as "furnish" and is held in a holding bin 18.

The preferred resin is an isocyanate binder such as polymeric methane di-isocyanate (PMDI). Phenolic or other resins might also be used but generally have less favourable properties. The preferred wax is a paraffin emulsion such as Mobilcer™ available from Mobile Australia, or similar products available from Dynea and Oest. Other additives such as pesticides, fungicides and fire retardants can be added at this point and mixed to ensure uniform distribution throughout the finished product matrix.

From bin 18, the furnish is supplied to a mat former 19 where the strands are aligned and deposited to form a mat of the required mass. A combination of alignment and mass controls the mechanical properties of the mat produced. The strands are formed in substantially aligned or unidirectional arrangement. Typically at least 70% of the strands are aligned. Some board products may require a central layer with strands aligned perpendicular to top and/or bottom layers.

The mat then passes a checking station 20 which carries out weight, moisture and metal detection. Any rejected material is conveyed either as waste to the heat plant or set aside for special processing.

Mats which pass the checking station are passed through a preheating station prior to the continuous press 21 to form billets or boards, typically around 30 to 90 mm in thickness for billets and around 8 to 30 mm thickness for boards, all up to 2.7 m wide and 15 m long. The press heats the material to above 100° C. for at least 1 minute. The billets are cooled 22 and trimmed 23 and/or sawn 24 into construction timber products.

A product formed from eucalypts using a process of this kind can be manufactured with full structural rating, and free of knots, bow, twist and wane. The density profile of the material is also substantially uniform. It may in the case of the board product be suitable for uses such as flooring, concrete formwork, decking material and in the case of lumber for structural wood products such as beams and columns, headers and lintels, joists and rafters, walls, studs and plates, and joinery products for example.

The product has been demonstrated to provide a number of advantages over most other softwood and hardwood products. It exhibits a high surface soundness, moisture resistance and shows a low swell rate in the presence of moisture. Additionally, the screw and nail holding performance is high in all planes.

Test products using Bluegum (*E. Globulus*) logs and Karri (*E. Diversicolor*), thinnings had the following characteristics:

1 Modulus of elasticity of around 14,000 N/mm$^2$ for Bluegum and 20,000 N/mm$^2$ for Karri.

2. Swell of less than 2% in a standard 24 hour moisture swell test for both products.

3. An internal bond strength of 1.21 N/mm$^2$.

4. High screw and nailing performance in all planes.

5. Uniform density profile.

6. A surface soundness of 2.42 N/mm$^2$.

These characteristics, particularly the modulus of elasticity are substantially better than those of alternative products, such as Radiata glulam, Douglas fir glulam, Hyspan LVL and MGP12 Pine, for which the moduli are around 12,500 N/mm$^2$, 13,500 N/mm$^2$, 13,500 N/mm$^2$ and 12,700 N/mm$^2$ respectively, for example.

The foregoing describes only a limited number of product embodiments and modifications can be made without departing from the scope of the invention.

The invention claimed is:

1. A hard wood strand product including substantially aligned strands of one or more eucalypts bonded together with a binder including a polymeric diisocyanate resin and a wax, the product having a modulus of elasticity greater than 14,000 N/mm$^2$ and a swell of less than 2% in a standard 24 hour moisture swell test.

2. A product as in claim 1 wherein the eucalypts are selected from the species Bluegum (*E. Globulus*), Karri (*E. Diversicolor*), Sydney Bluegum (*E. Saligna*), Marri (*E. Calophylla*) or Jarrah (*E. Marginata*).

3. A product as in claim 1 wherein the strands have an average length between 145 mm and 180 mm.

4. A product as in claim 1 wherein the strands have an average width of about 10 to 25 mm.

5. A product as in claim 1 wherein the strands have an average thickness between 0.5 mm and 1.5 mm.

6. A product as in claim 1 wherein at least 70% of the strands are fully aligned.

7. A product as in claim 1 having a density of between 600 kg/m$^3$ to 850 kg/m$^3$.

8. A product as in claim 1 which is a lumber or board product.

9. A product as in claim 1 wherein the strands used to form the product are dried to less than 5% moisture.

10. A product as in claim 1 including substantially aligned strands of one or more 8 to 12 year old eucalypts.

11. A method of manufacturing a hard wood strand product having a modulus of elasticity greater than 14,000 N/mm$^2$ and a swell of less than 2% in a standard 24 hour moisture swell test, comprising the steps of:

a) forming strands from logs of eucalypts;

b) adding a binder including a polymeric diisocyanate resin and a wax to the strands;

c) forming a mat with the binder and the strands which are substantially aligned; and, d) pressing and heating the mat using a press to form the strand product.

12. A method as in claim 11, wherein the logs are harvested from plantation trees having an age between 8 years and 12 years.

13. A method as in claim 11, additionally comprising the step of drying the strands to less than 5% moisture before adding the binder.

* * * * *